US007841220B2

(12) United States Patent
Lim et al.

(10) Patent No.: US 7,841,220 B2
(45) Date of Patent: Nov. 30, 2010

(54) DRUM-TYPE WASHING MACHINE

(75) Inventors: Hee Tae Lim, Seoul (KR); Jae Won Chang, Seoul (KR); Hyun Seok Seo, Seoul (KR); Min Gyu Jo, Seoul (KR)

(73) Assignee: LG Electronics Inc., Seoul (KR)

( * ) Notice: Subject to any disclaimer, the term of this patent is extended or adjusted under 35 U.S.C. 154(b) by 2 days.

(21) Appl. No.: 12/230,031

(22) Filed: Aug. 21, 2008

(65) Prior Publication Data

US 2009/0044574 A1 Feb. 19, 2009

Related U.S. Application Data

(63) Continuation-in-part of application No. 11/529,759, filed on Sep. 29, 2006.

(30) Foreign Application Priority Data

Sep. 30, 2005 (KR) ..... 10-2005-0092609

(51) Int. Cl.
*D06F 29/00* (2006.01)

(52) U.S. Cl. ..... 68/23.1; 68/23 R; 68/19; 68/13 R; 68/139; 68/140

(58) Field of Classification Search ..... 68/140, 68/13 R, 19, 23 R, 23.1, 139
See application file for complete search history.

(56) References Cited

U.S. PATENT DOCUMENTS

| | | | | |
|---|---|---|---|---|
| 912,038 | A | 2/1909 | Seifert | |
| 1,077,043 | A | 10/1913 | Darrow | |
| 1,470,245 | A | 10/1923 | Slider | |
| 1,611,895 | A | 12/1926 | Dienner | |
| 1,787,427 | A | 1/1931 | Eckhard | 68/140 |
| 2,089,066 | A | 8/1937 | Morrill | 248/26 |
| 2,152,458 | A | 3/1939 | Bergman | 172/36 |
| 2,153,418 | A | 4/1939 | Haberstump | 286/5 |
| 2,165,884 | A | 7/1939 | Chamberlin et al. | 8/159 |
| 2,191,607 | A | 2/1940 | Chamberlin et al. | 237/20 |
| 2,296,257 | A | 9/1942 | Breckenridge | 68/24 |
| 2,296,261 | A | 9/1942 | Breckenridge et al. | 68/24 |
| 2,296,267 | A | 9/1942 | Baird | 68/23 |
| 2,323,765 | A | 7/1943 | Haberstump | 68/13 |
| 2,356,816 | A | 8/1944 | Breckenridge et al. | 68/12 |
| 2,356,818 | A | 8/1944 | Bruckman | 68/24 |
| 2,389,774 | A | 11/1945 | Haberstump | 220/10 |

(Continued)

FOREIGN PATENT DOCUMENTS

CN 1332816 A 1/2002

(Continued)

OTHER PUBLICATIONS

Chinese Office Action issued in Chinese Patent Application No. 200610142200.6 dated Mar. 8, 2010.

(Continued)

*Primary Examiner*—Michael Kornakov
*Assistant Examiner*—Katelyn B Whatley
(74) *Attorney, Agent, or Firm*—KED & Associates, LLP

(57) ABSTRACT

A drum-type washing machine is disclosed, in which bearings are received in the bearing housing assembly. The bearing housing assembly may include a support portion coupled to a motor, and a coupling portion connected to a damper bracket.

14 Claims, 9 Drawing Sheets

U.S. PATENT DOCUMENTS 2,408,509 A 10/1946 Clark ..... 68/23
2,434,476 A 1/1948 Wales ..... 68/19
2,498,181 A 2/1950 Reiter ..... 259/81
2,509,516 A 5/1950 Murphy ..... 29/215
2,510,836 A 6/1950 Russell et al. ..... 68/24
2,521,578 A 9/1950 Haberstump ..... 68/19
2,526,002 A 10/1950 Brotman ..... 68/140
2,526,048 A 10/1950 Russell ..... 68/24
2,527,239 A 10/1950 Woodson ..... 68/23
2,541,166 A 2/1951 Leef ..... 68/140
2,542,509 A 2/1951 Goriup ..... 68/153
2,556,490 A 6/1951 Chamberlin ..... 8/159
2,565,604 A 8/1951 Geiger ..... 68/140
2,579,472 A 12/1951 Chamberlin et al. ..... 68/24
2,579,836 A 12/1951 Lee et al. ..... 260/26
2,589,284 A 3/1952 O'Neil ..... 34/77
2,593,752 A 4/1952 Haberstump ..... 68/61
2,615,320 A 10/1952 Belaieff ..... 68/24
2,644,326 A 7/1953 Worst ..... 68/23
2,656,700 A 10/1953 Smith ..... 68/23
2,711,297 A 6/1955 Thiele ..... 248/18
2,717,135 A 9/1955 Douglas ..... 248/20
2,758,685 A 8/1956 Sisson ..... 192/3.5
2,774,621 A 12/1956 Kilbourne, Jr. ..... 228/23
2,785,557 A 3/1957 Stilwell, Jr. ..... 68/12
2,836,046 A 5/1958 Smith ..... 68/24
2,843,314 A 7/1958 Hansen ..... 230/232
2,873,599 A 2/1959 Buechler ..... 68/24
2,882,706 A 4/1959 Brucken ..... 68/23
2,895,319 A 7/1959 Rochefort ..... 68/3
2,908,871 A 10/1959 McKay ..... 331/108
2,930,217 A 3/1960 Rehmke ..... 68/24
2,972,877 A 2/1961 Platt ..... 68/18
2,984,094 A 5/1961 Belaieff ..... 68/24
2,986,914 A 6/1961 Brucken ..... 68/12
2,990,706 A 7/1961 Bochan ..... 68/12
2,995,023 A 8/1961 Douglas ..... 68/131
3,066,522 A 12/1962 Steinmüller ..... 68/24
3,089,326 A 5/1963 Belaieff ..... 68/24
3,098,581 A 7/1963 Marsilio ..... 220/46
3,153,951 A 10/1964 Whelan ..... 74/665
3,178,916 A 4/1965 Belaieff et al.
3,197,983 A 8/1965 Ilmer ..... 68/24
3,206,267 A 9/1965 Gruner et al. ..... 312/228
3,257,830 A 6/1966 Shelton ..... 68/133
3,273,361 A 9/1966 Smith ..... 68/12
3,333,444 A 8/1967 Bochan ..... 68/208
3,356,222 A 12/1967 Belaieff ..... 210/363
3,389,881 A 6/1968 Stelwagen ..... 248/18
3,391,469 A 7/1968 Reeder ..... 34/58
3,459,461 A 8/1969 Bannon, Jr. ..... 213/214
3,477,259 A 11/1969 Barnish et al. ..... 68/23.1
3,509,742 A 5/1970 Bauer ..... 68/23.1
3,531,954 A 10/1970 Krupsky ..... 68/18
3,927,542 A 12/1975 de Hedouville et al. ..... 68/17
4,114,406 A 9/1978 Horowitz et al. ..... 68/24
4,295,387 A 10/1981 Zhivotov et al. ..... 74/573
4,412,390 A 11/1983 Grant ..... 34/58
4,446,706 A 5/1984 Hartwig ..... 68/24
4,498,181 A 2/1985 Menown et al. ..... 372/38
4,618,193 A 10/1986 Cuthbert et al. ..... 312/264
4,819,460 A 4/1989 Obradovic ..... 68/23.7
4,989,684 A 2/1991 Conaway ..... 180/89.15
5,038,586 A 8/1991 Nukaga et al. ..... 68/12.01
5,080,204 A 1/1992 Bauer et al. ..... 188/129
5,199,690 A 4/1993 Marshall ..... 267/64.25
5,209,458 A 5/1993 Eubank et al. ..... 254/88
5,230,229 A 7/1993 Stadelmann et al. ..... 68/23.1
5,267,456 A 12/1993 Nukaga et al. ..... 68/12.24
5,280,660 A 1/1994 Pellerin et al. ..... 8/158
5,526,657 A 6/1996 Johnson ..... 68/3
5,657,649 A 8/1997 Lim ..... 68/23.3
5,711,170 A 1/1998 Johnson ..... 68/3
5,711,171 A 1/1998 Uhlin ..... 68/4
5,768,730 A 6/1998 Matsumoto et al. ..... 8/159
5,870,905 A 2/1999 Imamura et al. ..... 68/12.04
5,913,951 A 6/1999 Herr et al. ..... 81/158
5,961,105 A 10/1999 Ehrnsberger et al. ..... 267/216
5,979,195 A 11/1999 Bestell et al. ..... 68/23.2
6,032,494 A 3/2000 Tanigawa et al. ..... 68/12.06
6,122,843 A 9/2000 Noguchi et al. ..... 34/596
6,148,647 A 11/2000 Kabeya et al. ..... 68/140
6,343,492 B1 2/2002 Seagar et al. ..... 68/142
6,363,756 B1 4/2002 Seagar et al. ..... 68/210
6,460,382 B1 * 10/2002 Kim et al. ..... 68/140
6,474,114 B1 11/2002 Ito et al. ..... 68/140
6,477,867 B1 11/2002 Collecutt et al. ..... 68/12.06
6,481,035 B2 11/2002 Seagar et al. ..... 81/159
6,510,715 B1 1/2003 Simsek et al. ..... 68/12.06
6,510,716 B1 1/2003 Kim et al. ..... 68/24
6,516,638 B1 2/2003 Myerscough ..... 68/23.1
6,539,753 B1 4/2003 Ito et al. ..... 68/3
6,557,383 B1 5/2003 Ito et al. ..... 68/23.2
6,564,594 B1 5/2003 Ito et al. ..... 68/24
6,578,225 B2 6/2003 Jönsson ..... 8/159
6,578,391 B2 6/2003 Seagar et al. ..... 68/142
6,626,014 B2 9/2003 Heyder et al. ..... 68/140
6,981,395 B2 1/2006 Ryu et al. ..... 68/17
7,073,356 B2 7/2006 Nakamura et al. ..... 68/12.26
7,334,799 B2 2/2008 O'Hara ..... 277/361
2002/0166349 A1 11/2002 Lim et al. ..... 68/23.7
2003/0056302 A1 3/2003 Broker et al. ..... 8/159
2004/0025544 A1 2/2004 Kim et al. ..... 68/3
2004/0031295 A1 2/2004 Choi ..... 68/24
2004/0035155 A1 2/2004 Yoon ..... 68/145
2004/0123631 A1 7/2004 Chang ..... 68/23.1
2004/0129035 A1 7/2004 Chang ..... 68/23
2004/0163428 A1 8/2004 Kim et al.
2004/0237603 A1 12/2004 Kim et al. ..... 68/15
2004/0244121 A1 12/2004 Lim et al. ..... 8/159
2004/0244168 A1 12/2004 Lee ..... 29/283.5
2005/0028564 A1 2/2005 Lee et al. ..... 68/24
2005/0188472 A1 9/2005 Park et al. ..... 8/158
2006/0010612 A1 1/2006 Kim et al. ..... 8/158
2006/0011429 A1 1/2006 Park et al. ..... 188/322.13
2006/0016228 A1 * 1/2006 Chang et al. ..... 68/23.1
2006/0254321 A1 * 11/2006 Lim et al. ..... 68/12.01
2007/0125135 A1 * 6/2007 Kim et al. ..... 68/140
2007/0227200 A1 * 10/2007 Kim et al. ..... 68/140

FOREIGN PATENT DOCUMENTS

CN 1511997 A 7/2004
CN 1515732 A 7/2004
DE 19 12 481 U 3/1965
DE 24 01 888 A1 7/1975
DE 24 54 489 A1 5/1976
DE 26 33 604 A1 2/1978
DE 27 32 684 A1 2/1978
DE 27 46 989 A1 4/1978
DE 31 09 641 A1 2/1982
DE 31 34 633 A1 8/1982
DE 34 37 835 A1 5/1985
DE 38 11 583 A1 10/1989
DE 39 07 258 A1 10/1989
DE 39 34 434 A1 4/1991
DE 42 39 504 A1 5/1994
DE 43 10 594 A1 10/1994
DE 43 30 079 A1 3/1995
EP 0 124 939 B1 11/1984
EP 0 132 805 A1 2/1985
EP 0 272 949 B1 6/1988
EP 0 371 926 A1 6/1990
EP 0 405 068 B1 1/1991

| | | | |
|---|---|---|---|
| EP | 0 716 177 | B1 | 6/1996 |
| EP | 0 750 064 | A1 | 12/1996 |
| EP | 0 969 134 | A1 | 1/2000 |
| EP | 0 725 179 | B1 | 7/2000 |
| EP | 1 055 765 | A1 | 11/2000 |
| EP | 1 079 014 | B1 | 2/2001 |
| EP | 1 094 239 | B1 | 4/2001 |
| EP | 1 386 996 | B1 | 2/2004 |
| EP | 1 433 890 | B1 | 6/2004 |
| EP | 1 433 891 | A2 | 6/2004 |
| EP | 1 505 191 | A1 | 2/2005 |
| EP | 1 605 088 | A2 | 12/2005 |
| EP | 1 688 531 | A1 | 8/2006 |
| GB | 1120431 | | 7/1968 |
| GB | 2 096 649 | A | 10/1982 |
| GB | 2 157 326 | A | 10/1985 |
| GB | 2 202 867 | A | 10/1988 |
| JP | 48-64179 | | 8/1973 |
| JP | 54-028470 | | 3/1979 |
| JP | 56-116987 | A | 9/1981 |
| JP | 57-43792 | A | 3/1982 |
| JP | 59-211496 | A | 11/1984 |
| JP | 60-190998 | | 9/1985 |
| JP | 03-88479 | U | 9/1991 |
| JP | 04-092697 | A | 3/1992 |
| JP | 04-236988 | A | 8/1992 |
| JP | 04-240488 | A | 8/1992 |
| JP | 04-371194 | A | 12/1992 |
| JP | 05-084388 | A | 4/1993 |
| JP | 05-220293 | A | 8/1993 |
| JP | 06-079087 | A | 3/1994 |
| JP | 09-182368 | | 7/1997 |
| JP | 09-182370 | A | 7/1997 |
| JP | 10-201993 | A | 8/1998 |
| JP | 11-076680 | A | 3/1999 |
| JP | 2000-262796 | A | 9/2000 |
| JP | 2000-334194 | A | 12/2000 |
| JP | 2002-153695 | A | 5/2002 |
| JP | 2002-346281 | A | 12/2002 |
| JP | 2003-079995 | | 3/2003 |
| JP | 2003-230792 | A | 8/2003 |
| JP | 2004-513721 | | 5/2004 |
| JP | 2004-188204 | | 7/2004 |
| JP | 2005-198698 | | 7/2005 |
| JP | 2006-026408 | | 2/2006 |
| KR | 10-1999-0066050 | A | 8/1999 |
| KR | 10-1999-0079731 | A | 11/1999 |
| KR | 10-2001-0009545 | A | 2/2001 |
| KR | 10-2004-0011307 | A | 2/2004 |
| KR | 10-2004-0047223 | A | 6/2004 |
| KR | 10-2004-0058999 | A | 7/2004 |
| SU | 1181112 | A | 9/1986 |
| SU | 1663074 | A1 | 7/1991 |
| WO | WO 98/29595 | A2 | 7/1998 |

OTHER PUBLICATIONS

U.S. Final Office Action dated Mar. 19, 2010 issued in U.S. Appl. No. 11/529,759.

Notice of Opposition dated May 7, 2010 filed in the European Patent Office for European Patent Application No. 05013603.5 (Publication No. EP 1 619 286 B1).

U.S. Office Action dated Dec. 30, 2005 issued in U.S. Appl. No. 10/461,451.

U.S. Final Office Action dated Aug. 14, 2006 issued in U.S. Appl. No. 10/461,451.

U.S. Final Office Action dated Dec. 13, 2006 issued in U.S. Appl. No. 10/461,451.

U.S. Office Action dated Jan. 5, 2007 issued in U.S. Appl. No. 11/475,885.

U.S. Office Action dated Apr. 27, 2007 issued in U.S. Appl. No. 10/461,451.

U.S. Office Action dated Jun. 8, 2007 issued in U.S. Appl. No. 11/470,704.

U.S. Final Office Action dated Jul. 17, 2007 issued in U.S. Appl. No. 11/475,885.

U.S. Office Action dated Nov. 19, 2007 issued in U.S. Appl. No. 10/461,451.

U.S. Office Action dated Nov. 30, 2007 issued in U.S. Appl. No. 11/470,704.

U.S. Office Action dated Apr. 1, 2008 issued in U.S. Appl. No. 11/475,885.

U.S. Final Office Action dated May 15, 2008 issued in U.S. Appl. No. 11/470,704.

U.S. Final Office Action dated Jun. 16, 2008 issued in U.S. Appl. No. 10/461,451.

U.S. Office Action dated Sep. 5, 2008 issued in U.S. Appl. No. 11/165,332.

U.S. Office Action dated Sep. 11, 2008 issued in U.S. Appl. No. 11/470,704.

U.S. Final Office Action dated Feb. 25, 2009 issued in U.S. Appl. No. 11/165,332.

U.S. Office Action dated Feb. 25, 2009 issued in U.S. Appl. No. 12/198,269.

U.S. Office Action dated Sep. 21, 2009 issued in U.S. Appl. No. 12/267,457.

U.S. Office Action dated Oct. 15, 2009 issued in U.S. Appl. No. 11/529,759.

U.S. Office Action dated Feb. 2, 2010 issued in U.S. Appl. No. 12/198,269.

European Search Report dated Feb. 3, 2010 issued in Application No. 09178918.0.

U.S. Final Office Action dated Mar. 5, 2010 issued in U.S. Appl. No. 12/267,457.

* cited by examiner

DRUM-TYPE WASHING MACHINE

This application is a continuation-in-part of U.S. patent application Ser. No. 11/529,759, filed Sep. 29, 2006, and claims the benefit of the Korean Patent Application No. 10-2005-0092609, filed on Sep. 30, 2005, both of which are hereby incorporated in their entireties for all purposes as if fully set forth herein.

BACKGROUND OF THE INVENTION

1. Field of the Invention

The present invention relates to a drum-type washing machine. More particularly, the present invention is directed to a drum-type washing machine with a bearing housing assembly, in which a damper for damping vibration of a drum is connected to a damper bracket.

2. Discussion of the Related Art

FIG. 1 is a sectional view illustrating an inner structure of a related art drum-type washing machine, and FIG. 2 is a sectional view taken along line II-II of FIG. 1.

As shown in FIG. 1 or FIG. 2, the related art drum-type washing machine includes a cabinet 1 having a base 1*a* and a door 1*b*, a tub 2 provided in an inner side of the cabinet 1, a drum 3 rotatably disposed in the tub 2 to rotate laundry m and washing water filled therein by use of a lift 3*a*, a motor 4 for rotating the drum 3, a spring 5, a damper 6, and a balancer 7, wherein the spring 5, the damper 6 and the balancer 7 serve to attenuate vibration transferred to the tub 2.

The drum 3 is provided with a plurality of holes 3*b* to allow the washing water, which is stored in the tub 2, to flow into drum 3. The lift 3*a* is disposed in an inner side of the drum 3 and is rotated with the drum 3, whereby the laundry m inside the drum 3 is lifted and dropped by the lift 3*a*.

The tub 2 is spaced apart from the inner side of the cabinet 1 at a predetermined interval, and is connected to the cabinet 1 by springs 5. The damper 6 is connected to the tub 2 and the base 1*a* by a hinge so that the tub 2 can be supported by the base 1*a*. The spring 5 and the damper 6 serve to dampen vibration transferred from the tub 2 to the cabinet 1.

The door 1*b* of the cabinet 1 is rotatably provided on a front surface 1*d* so that laundry m can be loaded into the drum 3. Respective front surfaces 2*d* and 3*d* of the tub 2 and the drum 3 are provided with openings 2*c* and 3*c* so that the drum 3 is accessible through the opening associated with the door 1*b*.

A gasket 8 is disposed between the front surface 1*d* of the cabinet 1 provided with the door 1*b* and the front surface 2*d* of the tub 2, and serves to prevent the washing water from leaking out of the tub 2. The gasket 8 seals a gap formed between the inner side of the cabinet 1 and the front surface 2*d* of the tub 2.

The motor 4 is disposed on a rear surface of the tub 2 and serves to rotate the drum 3 disposed inside the tub 2.

The balancer 7 is disposed in the drum 3 and serves to balance the rotating drum 3. Also, the balancer 7 is formed with a predetermined weight and serves to attenuate vibration of the drum 3 produced by a centrifugal force acting on the drum 3 when it is rotated at high speeds during a dehydrating cycle, for example a spin cycle.

In the aforementioned related art drum-type washing machine, vibration generated by a rotating part, such as the drum or the motor, is directly transferred to the tub, whereby the vibration transferred to the tub is reduced by the damper connected with the tub. However, in this structure of the related art drum-type washing machine, since vibration still affects the tub, it should be spaced apart from the cabinet by a certain interval so that the vibration of the tub is not directly transferred to the cabinet.

For this reason, when the size of the tub is increased to increase the capacity of the washing machine, the size of the cabinet must also be increased.

Furthermore, in the structure of the related art drum-type washing machine, since the vibration of the tub is relatively severe and the damper for attenuating the vibration is directly connected with the tub, the design of the tub must consider a structure in view of rigidity and strength in order to effectively attenuate the vibration. The design of the structure, including the materials necessary to accomplish attenuating the vibration, increases the overall weight of the washing machine and affects the arrangement of other parts inside the cabinet. Accordingly, the structure causes an increase in the overall cost of manufacturing the washing machine.

SUMMARY OF THE INVENTION

Accordingly, the present invention is directed to a bearing housing assembly and a drum-type washing machine with the same, which substantially obviates one or more problems due to limitations and disadvantages of the related art.

An advantage of the present invention is to provide a bearing housing assembly and a drum-type washing machine with the same, in which the bearing housing assembly is formed by insert injection molding to improve durability of the drum-type washing machine and facilitate its assembly.

Additional advantages, objects, and features of the invention will be set forth in part in the description which follows, and in part will be apparent from the description, or may be learned from practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a bearing housing assembly of a drum-type washing machine, the bearing housing assembly including a first bearing housing, wherein the first bearing housing includes: a hub into which at least one bearing is inserted, the at least one bearing supporting a rotational shaft of a drum; a support portion extended from an outer circumference of the hub; and a coupling portion extended from the hub.

In another aspect of the present invention is a drum-type washing machine comprising: a tub receiving washing water therein; a drum rotatably disposed inside the tub; a drum rotational shaft transferring a rotational force of a motor to the drum; a damper bracket connected with a damper; and a bearing housing assembly formed including a first bearing housing, wherein the first bearing housing includes a hub into which at least one bearing is inserted, the at least one bearing supporting the drum rotational shaft, a support portion extended from an outer circumference of the hub, and a coupling portion extended from the hub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
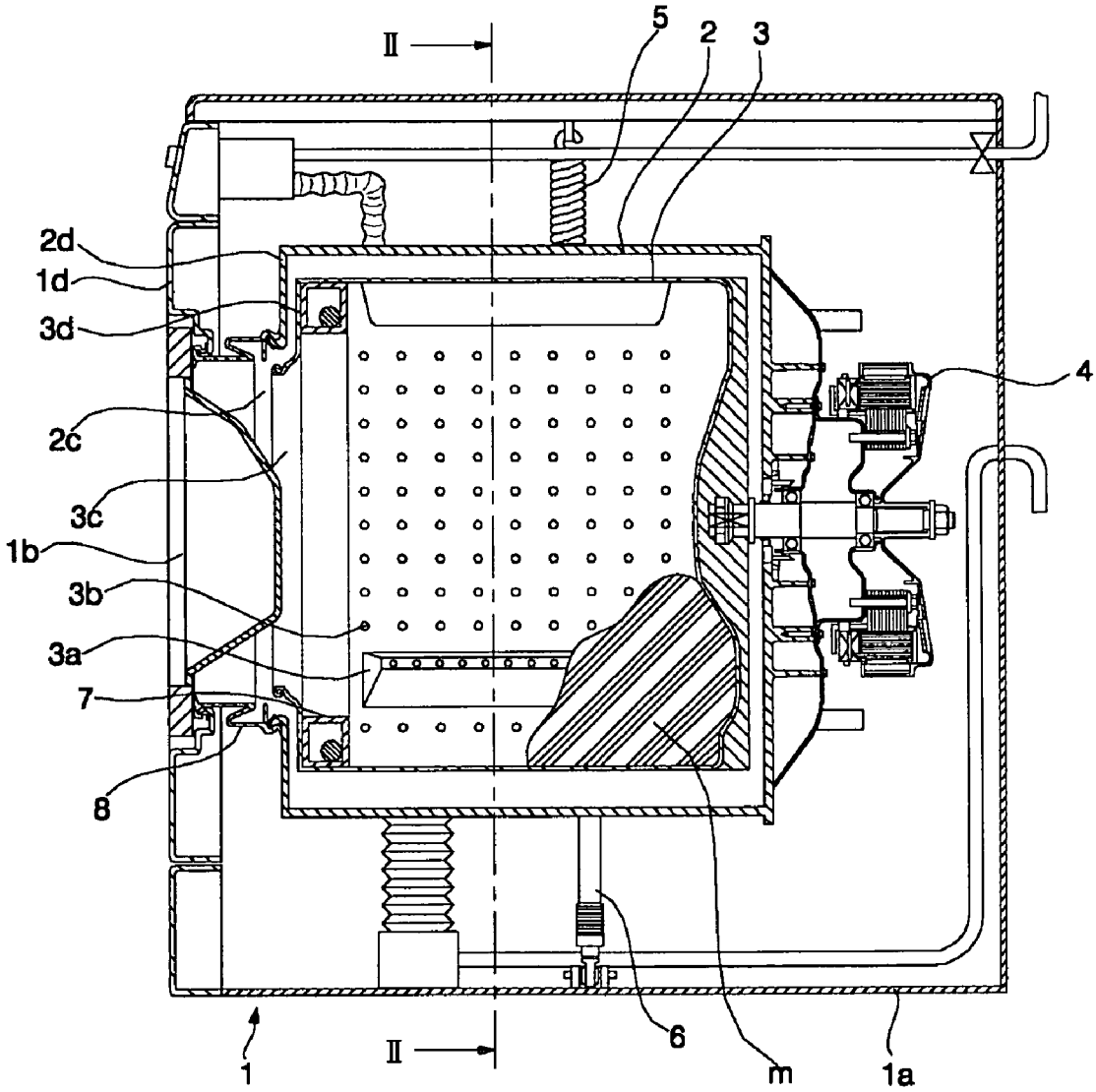
Fig. 1 Related Art
FIG. 1 is a sectional view illustrating an inner structure of a related art drum-type washing machine.
Figure 2:
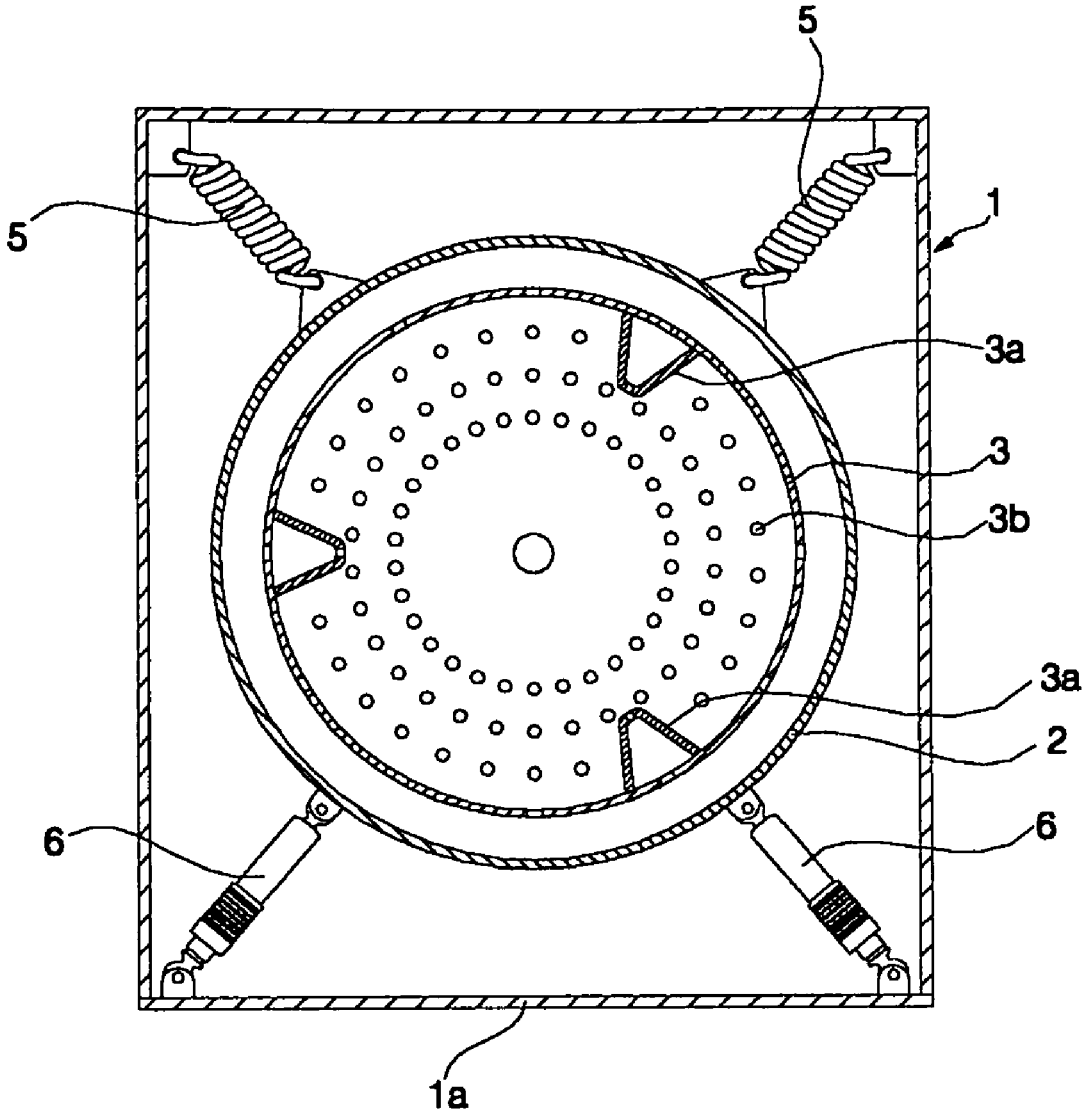
Fig. 2 Related Art
FIG. 2 is a sectional view along line II-II of FIG. 1.
Figure 3:
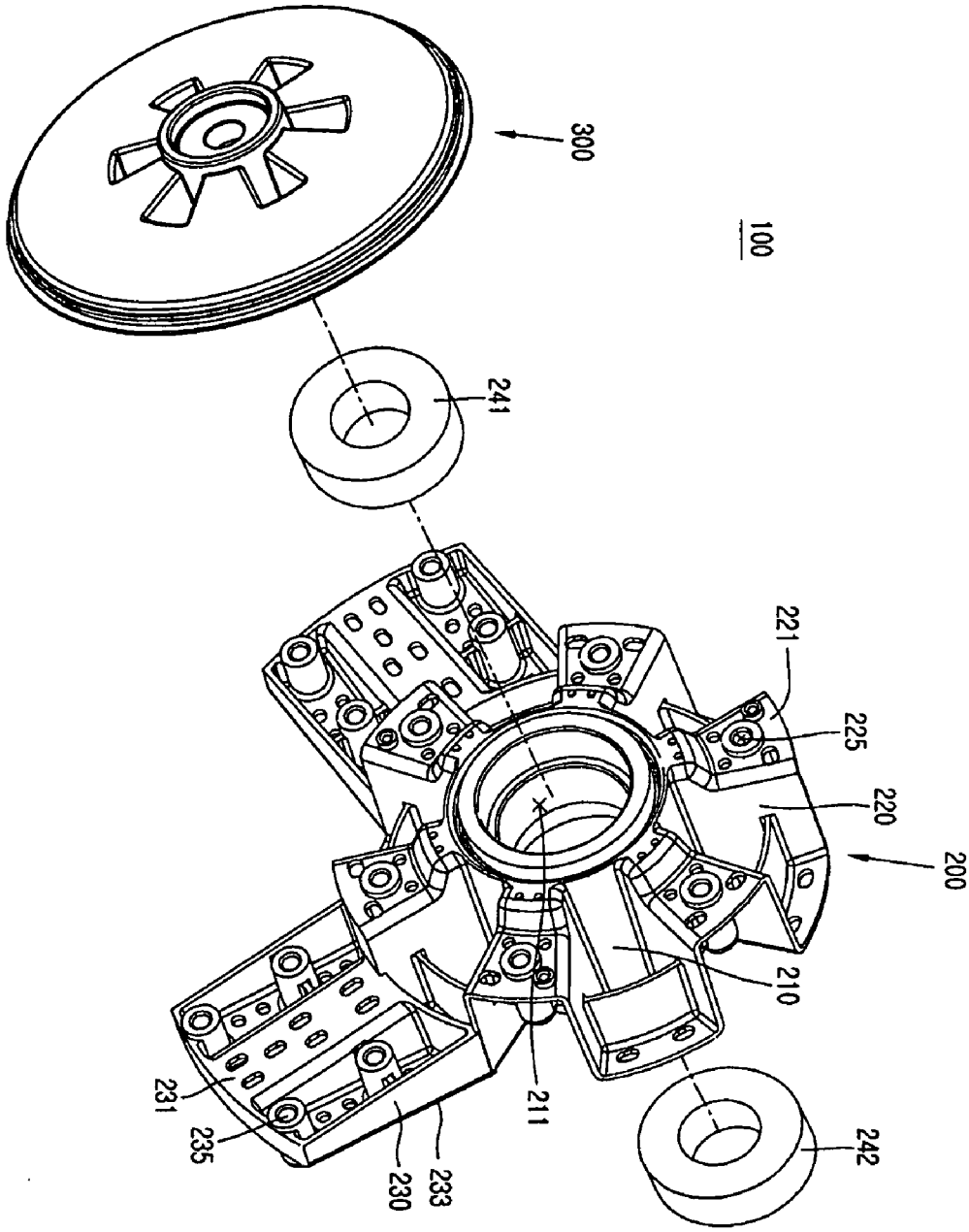
FIG. 3 is an exploded perspective view illustrating a bearing housing assembly provided in a drum type washing machine according to one embodiment of the present invention.

A bearing housing assembly 100 of FIG. 3 includes a first bearing housing 200 and a second bearing housing 300, wherein the second bearing housing 300 may be fixed to the first bearing housing 200 by an injection molding method.

When injection molding is implemented, the second bearing housing 300 is made of a plastic material and is molded to cover at least one outer surface of the first bearing housing 200. A support portion 220 of the first bearing housing 200 is provided with a plurality of through holes, and during the injection molding process, melted plastic flows into the through holes and hardens so as to enhance bonding strength between the first bearing housing 200 and the second bearing housing 300.

Referring to FIG. 3, at least two coupling portions 230 are provided with a plurality of through holes in the same manner as the support portion 220. Thus, if the coupling portion 230 is also covered by the second bearing housing 300 along with the support portion 220, it serves to increase the bonding strength between the first bearing housing 200 and the second bearing housing 300.

Furthermore, the support portion 220 is provided with circumferential ribs, and the strength and rigidity of the support portion is reinforced by the ribs. The ribs are located in the concave portions so as to connect convex portions in between.

The first bearing housing 200 includes a hub 210 into which bearings 241 and 242 are inserted, the support portion 220 extends from the outer circumference of the hub 210 and includes first female threaded holes 225, and the coupling portion 230 extends from the support portion 220 and includes second female threaded holes 235.

Figure 7:
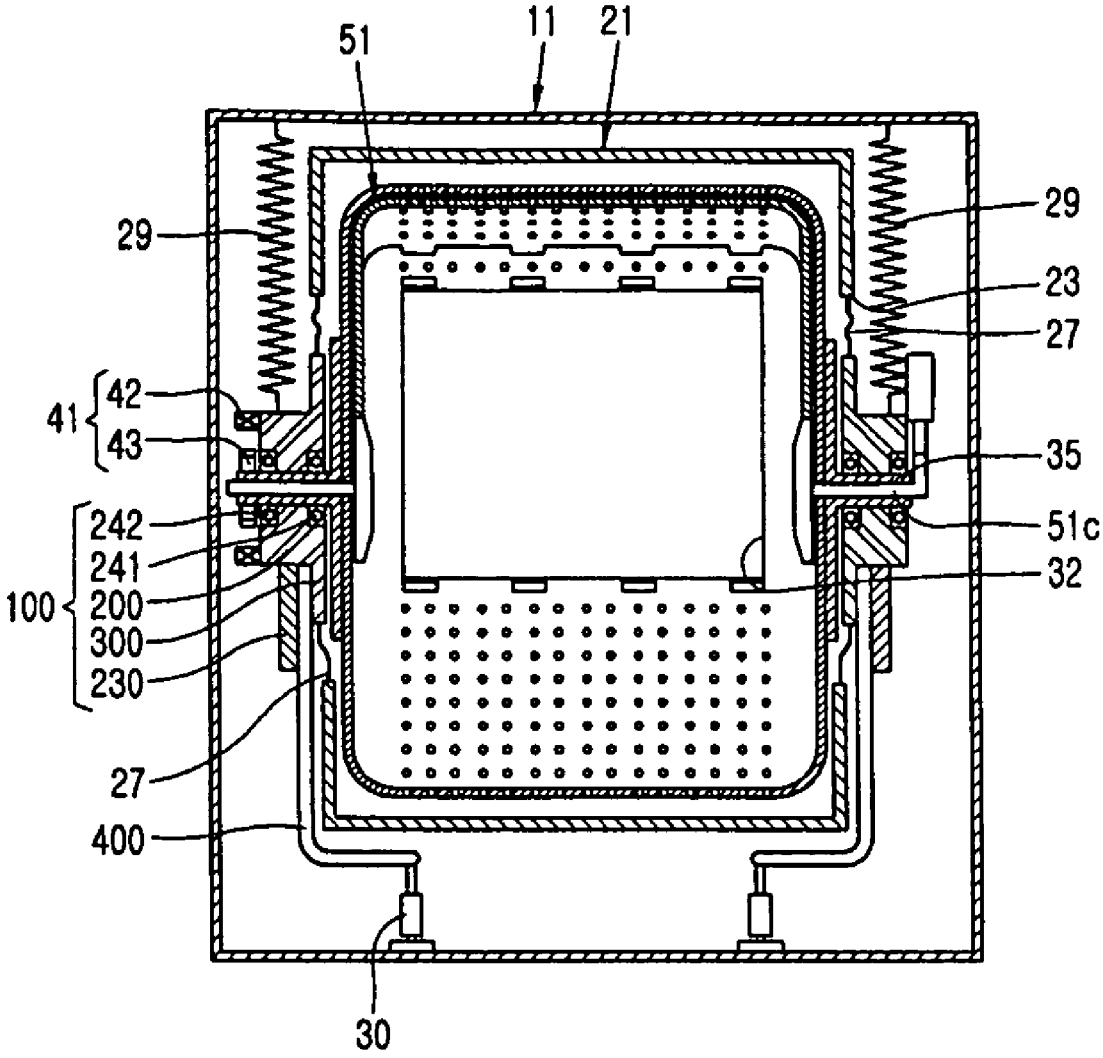
FIG. 7 is a front sectional view illustrating a drum-type washing machine according to first embodiment of the present invention.

The first bearing 241 and the second bearing 242 are inserted on either side of a central opening 211 of the hub 210 to rotatably support a drum rotational shaft 35 (see FIG. 7).

Figure 4:
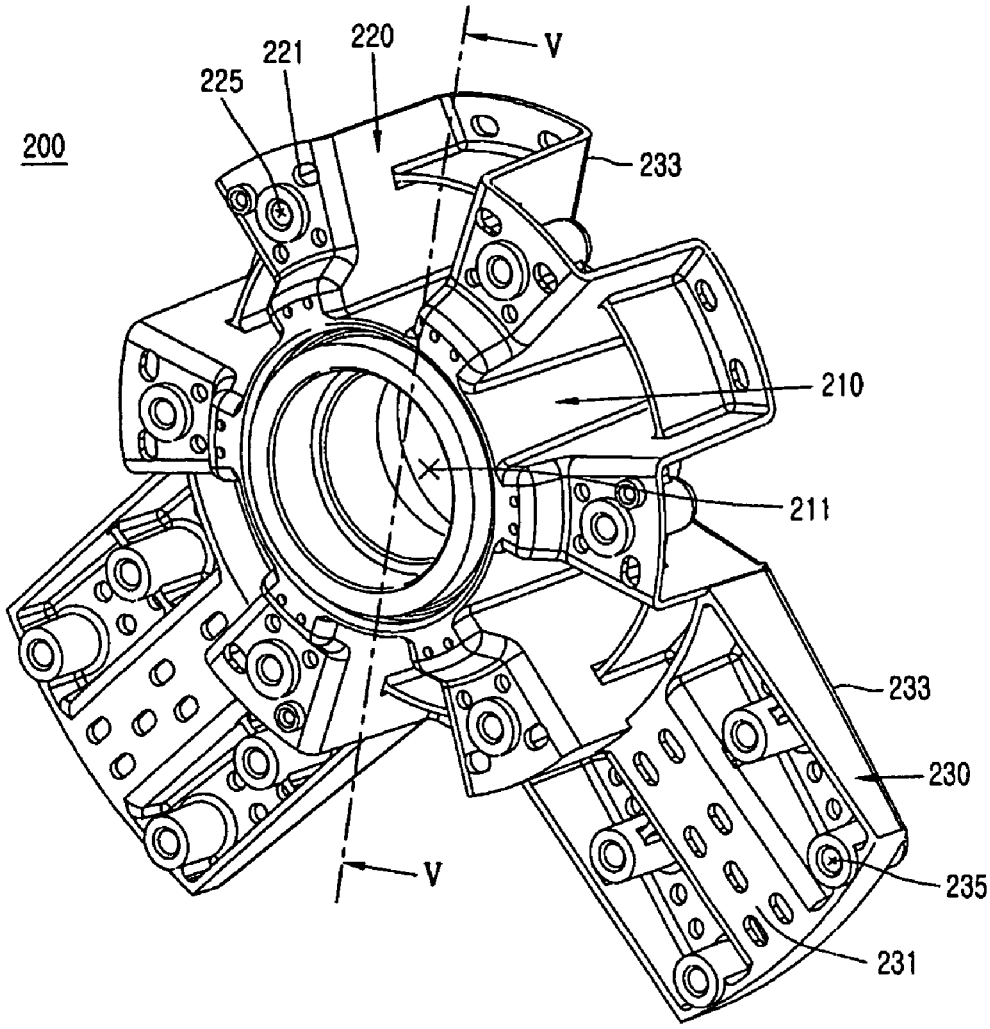
FIG. 4 is a perspective view illustrating an first bearing housing of FIG. 3, viewed from a front side.
Figure 5:
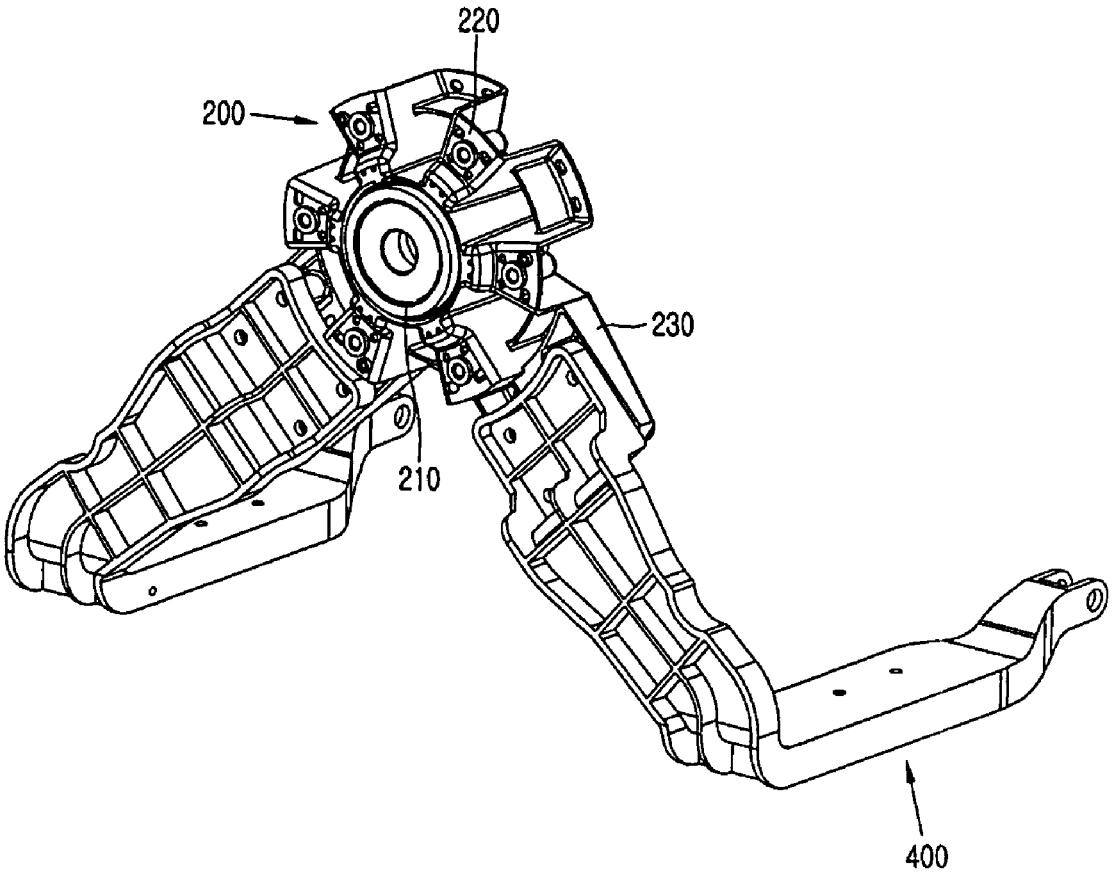
FIG. 5 is a perspective view illustrating a damper bracket fixed to the first bearing housing of FIG. 4, viewed from a rear side of the first bearing housing.
Figure 6:
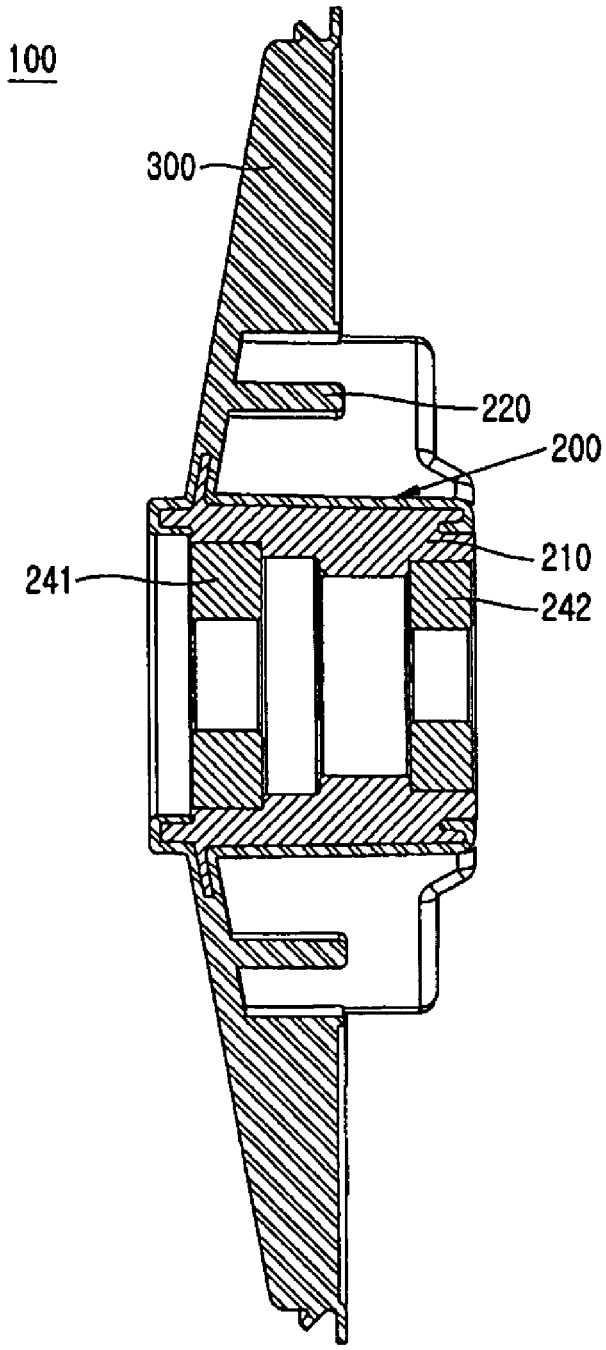
FIG. 6 is a sectional view along line V-V of FIG. 4.

The support portion 220 extends radially from the outer circumference of the hub 210 and has concave portions and convex portions in an alternating pattern. The support portion 220 is manufactured from, for example, a thin laminate having a plate thickness of 2 mm to 3 mm. As shown in FIGS. 3-5, a concave portion at one side of the support portion 220 is a convex portion at the other. Namely, a concave portion at the opposite side of the support portion 220 to the drum is a convex portion at the side where the drum is located.

As shown in FIG. 4, the convex portions on the rear surface of the support portion 220 are provided with first female threaded holes 225. In this embodiment, the rear surface is defined as the side opposite the side where the drum is located. The holes 225 are located in the aforementioned circular ribs. The ribs support the holes 225.

A stator of a motor can be fixed to the support portion 220 through the first female threaded holes 225. In the case where the stator of the motor is fixed to the support portion 220, the convex portions on the rear surface 223 of the support portion 220 are stepped so as not to interfere with a coil of the stator. Thus, the stator can be fixed to the support portion 220 more securely and a portion of the stator is now recessed within the support portion 220 thereby reducing the area necessary inside the cabinet.

The coupling portion 230 is extended from the hub 210 and protrudes further than the support portion 220. The coupling portion 230 can extend from the hub 210 several different ways. For example, the coupling portion 230 could be integral with the support portion, whereby the hub 210, the support portion 220 and the coupling portion 230 are all one piece or the coupling portion 230 can be manufactured separately and fixed to the support portion 220

The coupling portion 230 is coupled to the damper bracket. Accordingly, the coupling portion 230 has a thickness great enough to endure the loaded force. For example, the coupling portion 230 has a plate thickness greater than that of the support portion.

Next, the second bearing housing 300 is fixed to the front surface of the first bearing housing 200. The front surface 221 of the support portion 220 is covered by the second bearing housing 300 by injection molding, for example. The second bearing housing 300 can be made of a plastic material, and the first bearing housing 200 can be made of metal material, for example, aluminum.

The second bearing housing 300 may be formed to cover the coupling portion 230 as well as the support portion 220. Also, the second bearing housing 300 may be formed to cover one side or both sides of the first bearing housing 200.

As the bearing housing assembly is made by injection molding with an insert of the first bearing housing 200, it is not necessary to separately manufacture and assemble various parts, whereby the manufacturing process is simplified and the difficulties in assembling the washing machine are reduced.

Furthermore, since the first bearing 241 and the second bearing 242 are disposed together within the hub 210, misalignment of the shaft between the bearings 241 does not occur.

Moreover, the coupling portion 230, to which relatively great load is applied may be made of a rigid material, and the support portion 220 may be made of a thin plate, whereby the weight and size of the washing machine is reduced.

In a first embodiment, the drum-type washing machine may be provided with a bearing housing assembly which will be described with reference to FIG. 7.

FIG. 7 is a front sectional view illustrating the drum-type washing machine, especially a top loading drum-type washing machine provided with a bearing housing assembly.

The basic structure of a top loading drum-type washing machine is well known.

In the present application, the top loading drum-type washing machine includes a cylindrical cabinet 11 provided with an opening formed at one surface thereof, wherein a door is provided in the opening to allow the loading of laundry in and out of the washing machine.

Tub 21 is formed as a single body including an opening that corresponds to the opening of the cabinet 11 to load the laundry and through holes 23 at either side of the tub 21. A drum 51 is rotatably received within the tub 21 and is provided with the opening formed at one area of a circumferential surface, wherein the opening is aligned with the opening in the tub 21 to allow the loading of laundry in and out of the washing machine.

Furthermore, the top loading drum-type washing machine includes a bearing housing assembly 100 by which a drum rotational shaft 35 of the drum 51 is supported, wherein two bearing housing assemblies 100 are located at both sides of the tub 21.

A drum door 32 is rotatably disposed in the opening of the cabinet around a door rotational shaft 51*c* so as to open and close by rotating about the shaft 51*c*. A controller (not shown) is provided to control the drum 51 during wash cycles.

In the aforementioned top loading drum-type washing machine, the bearing housing assembly 100 includes an first bearing housing 200 and a second bearing housing 300 as described above, and supports the drum rotational shaft 35 fixed to the drum 31.

The first bearing 241 and the second bearing 242 are inserted within the opening 211 of the hub 210 of the inert housing 200, and rotatably support the drum rotational shaft 35. Moreover, a water seal (not shown) is inserted between the second bearing housing 300 and the front surface 221 of the support portion 220, and serves to prevent water from the tub 21 from flowing to the bearing housing assembly 100.

A stator 42 of a drum driving motor 41 is fixed to the rear surface 223 of the support portion 220 of the first bearing housing 200 by fitting bolts into the first female threaded holes 225. A rotor 43, corresponding to the stator 42, is fixed to the drum rotational shaft 35.

A gasket 27 is provided between the tub 21 and the bearing housing assembly 100 in the through holes 23 of the tub 21 so as to prevent water inside the tub 21 from leaking into the cabinet. The gasket 27 is flexible enough to prevent vibration transfer from the bearing housing assembly 100 to the tub 21.

Moreover, one end of a damper bracket 400 is fitted through the second female threaded holes 235 formed in the coupling portion 230 of the first bearing housing 200. The other end of the damper bracket 400 is fitted to the damper 30 to allow the damper 30 to damp vibration of the drum 31.

The damper bracket 400 is shown to have an inwardly bent shape. However, the damper bracket 400 may have any shape. In this embodiment, the damper bracket 400 is inwardly bent to position the bracket close to the center of gravity of the drum 31, whereby the damper can more stably damp vibration of the drum.

In FIG. 7, a spring 29 is provided between the cabinet and the bearing housing assembly.

In the above embodiment, while the top loading washing machine has been exemplarily described, the present invention can be applied to a front loading washing machine.

Figure 8:
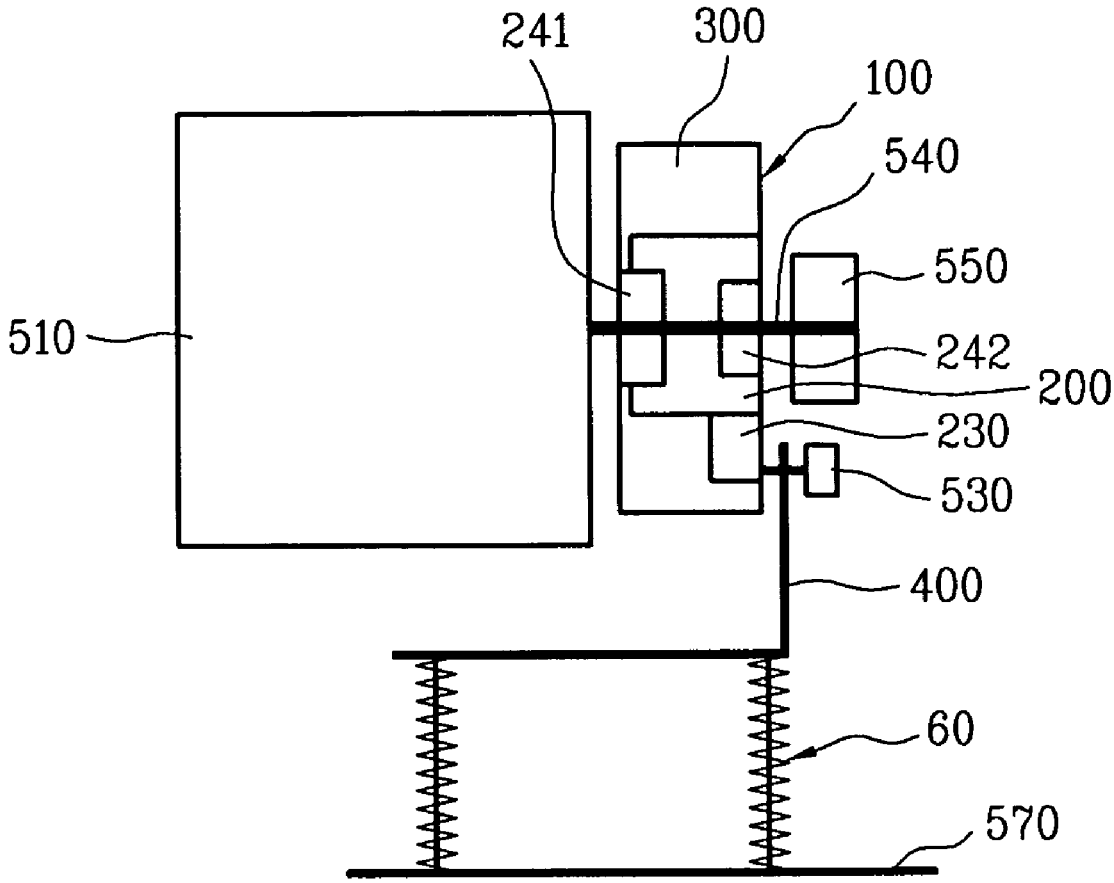
FIG. 8 is a sectional view illustrating a drum-type washing machine according to second embodiment of the present invention.
Figure 9:
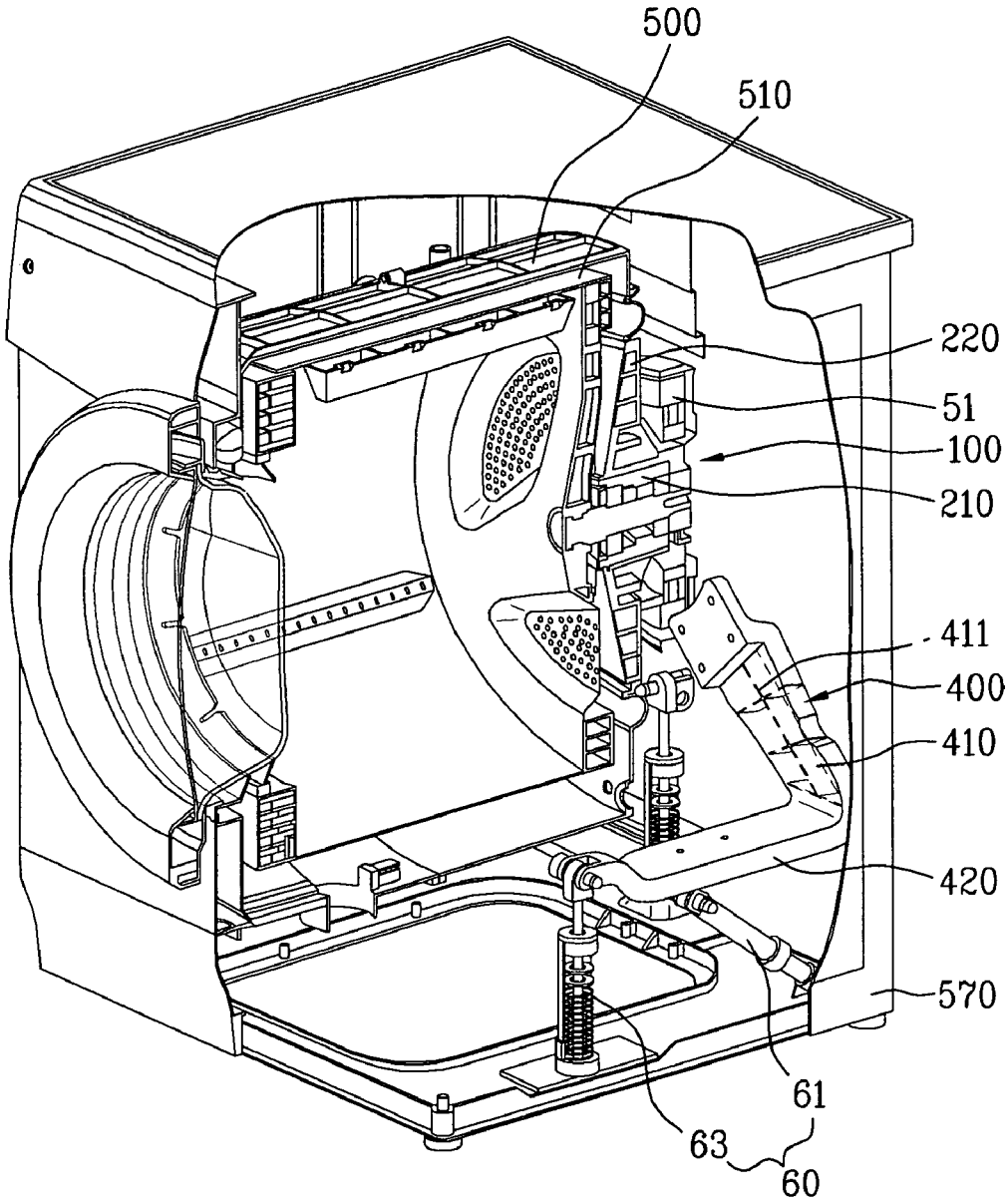
FIG. 9 is a perspective view of the drum type washing machine in FIG. 8 with a partial cut away view.

FIG. 8 illustrates a section of a drum type washing machine in accordance with a second embodiment of the present invention schematically, and FIG. 9 illustrates a perspective view of the drum type washing machine in FIG. 8 with a partial cut away view.

Referring to FIGS. 8 and 9, the drum type washing machine may include a cabinet 570 defining an exterior of the drum type washing machine, a drum 510 rotatably provided in the cabinet 570, a rotating shaft 540 for rotating the drum 510, and a motor 550 connected to the rotating shaft 540. The drum type washing machine may include a bearing housing assembly 100 configured to support the rotating shaft 540. The bearing housing assembly 100 may include a first bearing housing 200 for direct support of the rotating shaft 540, and a second bearing housing 300 disposed on an outside of the first bearing housing 200.

The drum type washing machine also may include a suspension device 60 for attenuating vibration transmitted from the drum to the cabinet 570. A damper bracket 400 configured to support the bearing housing assembly 100 may be provided between the suspension device 60 and the bearing housing assembly 100.

In detail, the damper bracket 400 may have one side coupled to a lower side of the bearing housing assembly 100 with a coupling portion 230, and the other side fixedly secured to the suspension device 60. The suspension device 60 may be projected from a bottom of the cabinet 570, and may include attenuating members, such as dampers or springs.

In the embodiment, a plurality of the coupling portions 230 are formed in an outward radial direction from the bearing housing assembly 100, for an example, at least two as illustrated in FIGS. 3-5. The damper bracket 400 may be coupled to each of the second fastening bosses 235 of the coupling portions 230. The number of coupling portions 230 and damper brackets 400 used is not limited to two, rather, appropriate variations thereof are envisioned and are within the scope of the invention. Such variations may accommodate a range of situations, such as different load capacities or structural requirements.

As illustrated in FIG. 9, the damper bracket 400 may include an extension portion 410 and a connection portion 420 bent from the extension portion 410. In the illustrated exemplary embodiment, the extension portion 410 is extended downward in a radial direction from the bearing housing assembly 100, and the connection portion 420 extends from a bend in the damper bracket 400, the bend disposed at an end of the extension portion 410. Preferably, a plurality of the damper brackets 400 are provided, and more preferably, the damper brackets 400 are provided symmetrically under the bearing housing assembly 100. As a result, the extension portion 410, extended from a lower side of, and in the radial direction of the bearing housing assembly 100, uniformly distributes force to the damper bracket 400.

The connection portion 420 may transmit the distributed force from the extension portion 410 to the suspension 60. In detail, the connection portion 420 may be mounted substantially parallel to the bottom of the cabinet 570, and may be connected to a first suspension 61 having a damper and a second suspension 63 having a spring at an underside of the connection portion 420. Alternate dampers and configurations may be employed in order to accommodate various systems and structural requirements without departing from the scope of the invention.

The extension portion 410 may have reinforcing ribs 411 configured to reinforce the strength of the damper bracket 400, enhancing its strength to improve its ability to sustain the forces exerted on the extension portion 410.

Further, it is noted that the second bearing housing 300 may be connected to the first bearing housing 200 on a front side of the first bearing housing 200, i.e., on a front side of the supporting portion 220.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A drum type washing machine, comprising;

A cabinet;

A tub provided in the cabinet;

A drum rotatably provided in the tub;

A motor to rotate the drum;

An integral bearing housing assembly, including;

A hub configured to receive a rotational shaft of the drum therethrough and bearings positioned at a central portion thereof;

A supporting portion that extends radially outward from an outer circumference of the hub, wherein the motor is mounted on the supporting portion; and A coupling portion that extends radially outward from the supporting portion;

A first bracket attached to the coupling portion of the bearing housing assembly and extending outward in a radial direction with respect to the rotational shaft;

A second bracket coupled to the coupling portion of the bearing housing assembly and extending outward in a radial direction with respect to the rotational shaft, wherein the first and second brackets are symmetrically positioned with respect to the rotational shaft; and First and second dampers respectively coupled to the first and second brackets so as to reduce the vibration of the drum.

2. The drum type washing machine as claimed in claim 1, wherein the first bracket is coupled to the coupling portion by 4 bolts.

3. The drum type washing machine as claimed in claim 1, wherein coupled portions of the first bracket and the coupling portion of the bearing housing form a face that faces the drum and extends radially outward from the hub, and is then bent opposite to the drum and then extends radially outward again.

4. The drum type washing machine as claimed in claim 3, wherein the first bracket coupled to the coupling portion extends radially outward beyond an outer circumferential surface of the drum.

5. The drum type washing machine as claimed in claim 4, wherein a portion of the first bracket extends in a rotational axis direction of the drum at a portion thereof which is positioned radially outside of the drum.

6. A drum type washing machine, comprising:

a tub that receives water therein;

a drum rotatably provided in the tub;

a motor to rotate the drum;

a bearing housing, including:

a hut to rotatably support a rotational shaft of the drum;

a supporting portion that extends from an outer circumference of the hub; and a coupling portion that extends in a radial direction of the supporting portion; and a first bracket attached to the coupling portion of the bearing housing and extending in a radial direction with respect to the rotational shaft, wherein a width of the first bracket decreases as a distance from the rotational shaft increases.

7. The drum type washing machine as claimed in claim 1, wherein a combination of the supporting and coupling portions of the bearing housing and the first bracket form a face that extends in a radial direction opposite the drum and is bent toward the drum.

8. The drum type washing machine as claimed in claim 7, wherein the face is shaped such that it continues to extend in the radial direction and is bent opposite to the drum and then extends again in the radial direction.

9. The drum type washing machine as claimed in claim 8, wherein the first bracket is coupled to the coupling portion at a location of the face where the face extends in the radial direction after being bent toward the drum.

10. The drum type washing machine as claimed in claim 1, wherein the coupling portion is recessed to provide a space for a rotor of the motor.

11. The drum type washing machine as claimed in claim 1, wherein a width of the portion of the first bracket to which the first damper is connected is less than a portion at an opposite end of the first bracket.

12. The drum type washing machine as claimed in claim 1, wherein the portion of the first bracket to which the first damper is connected is lower than an opposite portion of the first bracket.

13. The drum type washing machine as claimed in claim 1, further comprising a flexible material positioned between the tub and the bearing housing assembly so as to prevent water inside the tub from leaking toward the bearing housing assembly and to allow the bearing housing to move relative to the tub.

14. The drum type washing machine as claimed in claim 1, wherein the tub is supported more rigidly than the drum is supported.

* * * * *